United States Patent [19]

Herrin

[11] Patent Number: 4,477,013

[45] Date of Patent: Oct. 16, 1984

[54] SEE THROUGH FILE FOLDER

[76] Inventor: Melvin B. Herrin, 1156 Mill Rd. Cir., Rydal, Pa. 19046

[21] Appl. No.: 529,925

[22] Filed: Sep. 7, 1983

Related U.S. Application Data

[63] Continuation of Ser. No. 241,627, Mar. 9, 1981, abandoned.

[51] Int. Cl.[3] ..... B65D 37/00

[52] U.S. Cl. ..... 229/1.5 R; 40/359; 229/71

[58] Field of Search ..... 229/1.5 R, 71, 68 R; 40/359; 312/184; 281/29; 16/DIG. 13

[56] References Cited

U.S. PATENT DOCUMENTS

| | | | |
|---|---|---|---|
| 1,928,337 | 9/1933 | McClanahan | 229/72 |
| 2,260,407 | 10/1941 | Schade | 129/1 |
| 2,537,135 | 1/1951 | Hempel | 281/29 |
| 2,725,881 | 12/1955 | Goldman | 281/29 |
| 2,995,387 | 8/1961 | Goldman | 281/29 |
| 3,283,421 | 11/1966 | Schott | 35/61 |
| 3,337,119 | 8/1967 | Bowers et al. | 229/68 R |
| 3,459,361 | 8/1969 | Matton | 229/72 |
| 3,643,363 | 2/1972 | Biro | 40/359 |
| 3,863,828 | 2/1975 | King | 229/1.5 R |
| 4,001,960 | 1/1977 | Holson | 281/31 |
| 4,064,206 | 12/1977 | Seufert | 264/26 |
| 4,179,252 | 12/1979 | Seufert | 425/174.6 |

*Primary Examiner*—Stephen P. Garbe

*Attorney, Agent, or Firm*—Lerner, David, Littenberg, Krumholz & Mentlik

[57] ABSTRACT

A file folder comprises a rear panel of stiff paper-stock and a front panel of transparent plastic material connected to the rear panel along a hinge line. Preferably, the hinge line is provided by a soft crease in the front panel which defines an inturned margin adhesively secured to the rear panel. The file folder is durable, is relatively inexpensive to manufacture and decorate, and affords notations to be made thereon using a variety of writing implements. Several different embodiments of the invention are disclosed.

5 Claims, 7 Drawing Figures

SEE THROUGH FILE FOLDER

This is a continuation of application Ser. No. 241,627 filed Mar. 9, 1981, now abandoned.

FIELD OF THE INVENTION

The present invention relates to folders for containing documents, and more particularly, the present invention relates to a see through file folder.

BACKGROUND OF THE INVENTION

The conventional manila paper file folder has been in use for decades. It is fabricated from a single sheet of manila paper which is cut and folded to provide front and rear panels hinged together along one edge. Usually, the rear panel is provided with a tab for indexing purposes.

While the conventional folder may function satisfactorily for its intended purpose, it has certain limitations. For instance, the opacity of the front panel prevents anything contained within the folder from being viewed from the front. As a result, information about the contents of the file is usually placed on the tab. However, due to the size and space limitations of the tab, only a limited amount of information can be recorded. It would be more desirable for an index sheet to be placed in the front of the file and the folder designed so that the index sheet or folder contents can be viewed through the front panel.

All-plastic folders having transparent front and rear panels are known. While these folders overcome some of the limitations of manila folders, they have other limitations. For instance, all-plastic folders lack the desired structural integrity, i.e. rigidity, which is an important requirement for a desirable file folder. All-plastic folders are more expensive to manufacture than manila folders because plastic is more expensive than paper. Also, all-plastic folders are more difficult to decorate with printing, and they do not allow index or other notations to be applied with as wide a variety of writing implements as do manila folders. Moreover, since all-plastic folders have hard crease hinge lines, it is difficult for them to be laid flat in open position without overstressing their hinge line, and repeated overstressing of the hinge line is likely to cause premature failure.

OBJECTS OF THE INVENTION

With the foregoing in mind, an object of the present invention is to overcome the limitations associated with conventional manila file folders and all-plastic file folders.

It is another object of the present invention to provide an improved file folder which permits a document contained within the folder to be viewed through the front panel of the folder and which enables indexing notations to be made with a wide range of writing implements.

Another object of the present invention is to provide a novel file folder of composite plastic and paper construction which is durable, inexpensive to manufacture, and capable of being decorated readily by inexpensive printing techniques.

A further object of the present invention is to provide a unique file folder which combines many of the advantages of all paper file folders with many of the advantages of all plastic file folders to provide a durable, inexpensive, easily decorated and used file folder.

SUMMARY OF THE INVENTION

More specifically, the present invention provides a unique file folder of composite plastic and paper construction. The folder comprises a rear panel fabricated of stiff paper and a front panel fabricated of translucent plastic material. One or the other of the panels is provided with a fold line extending along one of its edges to define a margin which is secured to the other panel. The fold line may be provided either in the rear panel or the front panel and the margin secured in any of several different ways. Preferably, the fold line is provided by forming a soft crease in a thermoplastic front panel utilizing a known high frequency heating and creasing technique. The soft crease is characterized by the absence of spring-back between the front panel and its rear panel connected margin, and this causes the folder to lay substantially flat when open.

BRIEF DESCRIPTION OF THE DRAWINGS

The foregoing and other objects, features and advantages of the present invention should become apparent when taken in conjunction with the accompanying drawings, in which.

DESCRIPTION OF PREFERRED EMBODIMENTS

Figure 1:
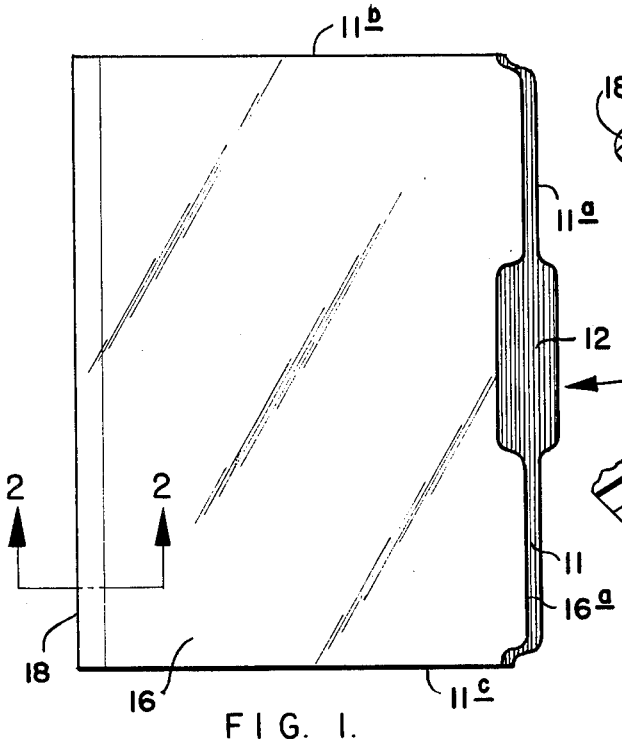
FIG. 1 is a plan view of a file folder embodying the present invention.
Figure 2:
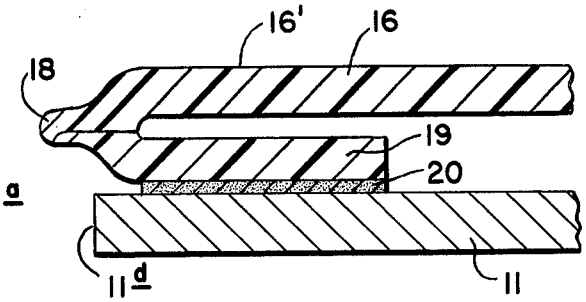
FIG. 2 is a greatly enlarged fragmentary sectional view taken on line 2—2 of FIG. 1.

Referring now to the drawing, FIG. 1 illustrates a file folder 10 which embodies the present invention. The folder 10 comprises an opaque rear panel 11 fabricated of conventional manila paper or stiff card-stock material. The rear panel 11 has a top edge **11*a* which is cut to provide an index tab 12. The rear panel 11 also has side edges 11*b* and 11*c* and a bottom edge 11*d* (FIG. 2). The rear panel 11** is of conventional size and shape as well known in the art. Being of paper, it can be decorated readily by conventional printing processes, and it enables information to be placed on the index tab utilizing a wide variety of writing implements, including a pencil.

In accordance with the present invention, the file folder 10 has a front panel 16 of stiff translucent, preferably clear transparent plastic such as rigid thermoplastic polyvinyl chloride or polystyrene which permits a document in the folder 10 to be viewed from the front. The front panel 16 overlies the rear panel 11 and is substantially coextensive therewith, covering substantially the entire area of the rear panel 11. The front panel 16 has a top edge **16*a* and opposite side edges disposed in substantial alignment or congruence with the edges 11*a*–11*c* of the rear panel 11**.

In the best mode embodiment of the present invention illustrated in FIGS. 1 and 2, the front panel 16 is provided with a fold or hinge line 18 which enables the front and rear panels to be opened and disposed in substantially coplanar relation with one another when the folder is laid on a flat surface. To this end, the hinge line 18 extends continuously across substantially the entire width of the front panel 16. The hinge line 18 thus forms in the front panel 16 a narrow margin 19 which is bent parallel to the front panel 16 in the manner illustrated in FIG. 2 when the folder 10 is closed. The panel margin 19 is permanently secured to the rear panel 11 by any of several conventional means, such as by a layer of adhesive 20 interposed between the margin 19 and the top surface of the rear panel 11 adjacent its lower edge 11*d*, as indicated in FIG. 2. If desired, additional hinge lines, not shown, may be disposed parallel to the hinge line 18 in either the front or rear panel to accommodate expansion of the folder in the usual manner.

Figure 2A:
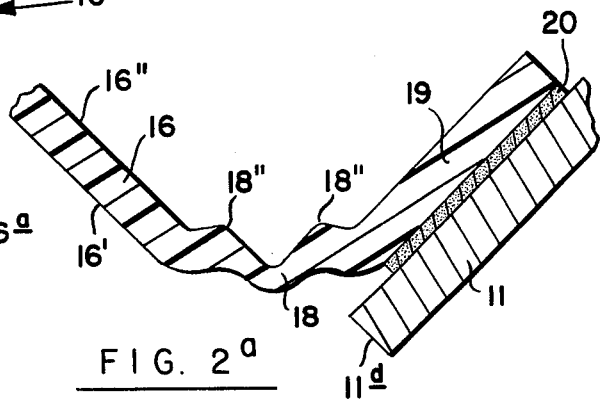
FIG. 2A is a view similar to FIG. 2 but illustrating the hinge portion of the folder as it is being opened.
Figure 2B:
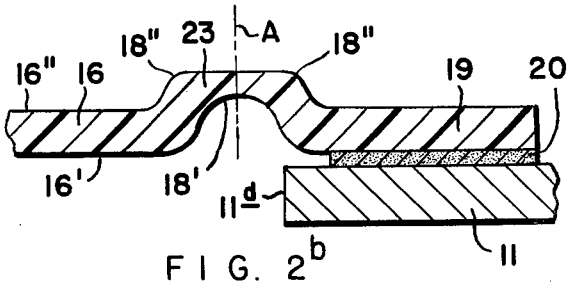
FIG. 2B is a view similar to FIG. 2A but illustrating the hinge portion of the folder when the folder is in its fully open configuration.

To enable the front panel 16 to be disposed substantially coplanar with the rear panel 11 when the file folder 10 is in its open configuration, the fold or hinge line 18 is defined by a so-called "soft crease" which has a unique transverse cross-sectional shape such as illustrated in FIG. 2B when the folder is open, such as illustrated in FIG. 2A when the folder is being opened or closed, and such as illustrated in FIG. 2 when the folder is closed. As used herein, the term "soft crease" means the absence of substantial spring-back between the front panel 16 and its margin 19. The absence of spring-back eliminates the propensity for the front panel 16 to lay against rear panel 11 such as would be the situation if the hinge were formed by conventional hard creasing techniques. Thus, the front panel 16 can be pivoted away from the rear panel 11 about the hinge line 18 without substantial bending of the front panel about a line parallel to the hinge line 18 and, therefore, without inducing fatigue-causing overstress in the hinge line 18.

The soft crease or hinge 18 is formed in accordance with the teachings of U.S. Pat. Nos. 4,064,206 and 4,179,252. These patents disclose a method and apparatus, respectively for forming a soft crease in a thermoplastic blank of the type utilized in the best mode embodiment of FIGS. 1 and 2. The disclosures of both of these patents are incorporated by reference herein.

In the referenced patented process, the soft crease or fold line 18 is formed by disposing a blank of plasticizer-free, thermoplastic polymer between a platen and an elongated rule, displacing the rule into engagement with the blank, applying a high frequency electric field to the blank between the rule and the platen, maintaining the rule at a relatively cool temperature during its engagement with the blank, and disengaging the rule from the blank and allowing the blank to cool. By way of example, and not by way of limitation, a soft crease can be formed in a 0.250 mm. thick blank of polyvinyl chloride material having a high impact resistance and a K value of 60 by utilizing a high frequency generator having a continuous output of 2500 watts, a power of 5.5 kVA at full load and a frequency of 27.12 MHz. The temperature of the rule is preferably maintained at about 100° C. with the rule penetrating the blank to a depth of 0.175 mm., i.e. approximately 70% of the thickness of the sheet. A preferred pressure utilizing a rule of 0.8 mm. thick having a bottom edge radius of 0.4 mm. is 5.0 kg/cm$^2$. One second of heating followed by one second of cooling produces the desired soft crease.

Upon cooling, a typical soft crease or hinge line 18 fabricated in accordance with the above-noted process is characterized by the cross-sectional configuration illustrated in FIG. 2B. This configuration may be described as being symmetrical with respect to a vertical center line A disposed perpendicular to the rear panel 11 and extending through the uppermost point of the concave curve 18' left by the bottom radius of the rule. The concave surface 18' faces toward the outside of the front panel 16, i.e. the side 16' in FIGS. 2, 2A and 2B. A pair of convex surface bulges 18'' are located on opposite sides of the center line A on the side 16'' of the blank opposite the concave surface 18'. An elongated narrow zone or web 23 of the panel 16 is offset upwardly above the inside 16'' of the panel 16 between the convex bulges 18''. The offset web 23 has a thickness in a range of 30–60% of the thickness of the panel 16, and the concave surface 18' has a depth approximately equal to the thickness of the panel 16.

The thus-described fold or hinge line 18 provides the aforementioned absence of substantial spring-back between the front panel 16 and the rear panel 11 when the panels are pivoted relative to one another during opening and closing of the file folder 10. As a result, the front and rear panels tend to lay flat and substantially coplanar when the folder 10 is open. Moreover, the soft crease hinge line 18 affords opening and closing of the file 10 a number of times without fatiguing of the hinge 18.

Figure 3:
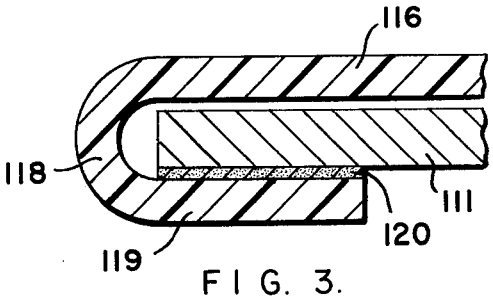
FIGS. 3, 4 and 5 are sectional views similar to FIG. 2 but illustrating different embodiments of the present invention.

In the embodiment of FIG. 1, the margin 19 of the front panel 16 is disposed intermediate the front panel 16 and the rear panel 11 and is secured to the rear panel 11 by the layer of adhesive 20. If desired, however, a front panel 116 may be secured to a rear panel 111 in the manner illustrated in FIG. 3 wherein the front panel margin 119 is fastened to the underside of the rear panel 111 by a layer of adhesive 120. In this embodiment, the rear panel 111 is disposed intermediate the margin 119 and the front panel 116. This embodiment provides the advantage of eliminating the edge on the inside of the file folder. While a soft crease may be utilized in the hinge or fold line 118, a hard crease such as produced by conventional creasing techniques may be utilized in those situations where all of the advantages of a soft crease hinge line may not be desired.

Figure 4:
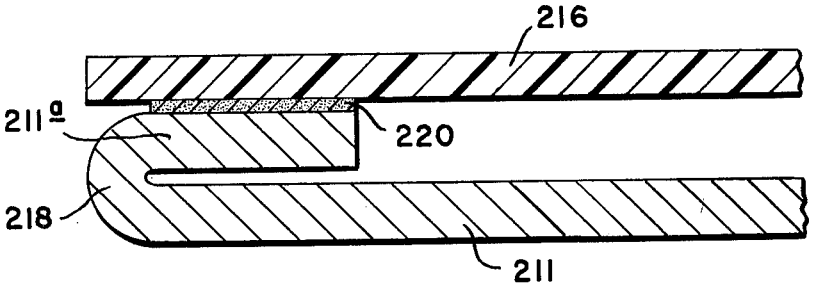

FIG. 4 illustrates another embodiment of the present invention wherein a transparent front panel 216 is secured by a layer of adhesive 220 onto an inturned margin 211*a* of a rear panel 211. In this embodiment, the rear panel 211, being fabricated of manila paper, provides a soft fold or crease 218 by virtue of the inherent characteristics of manila paper.

Figure 5:
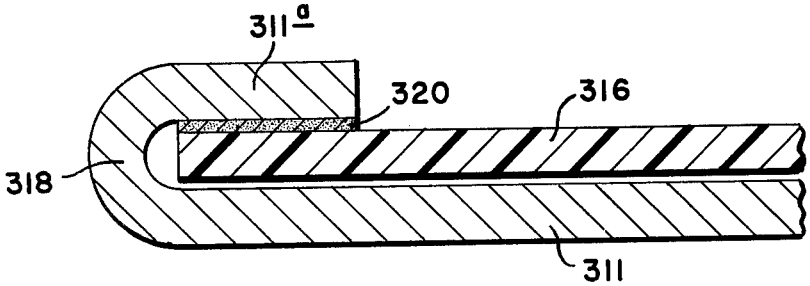

Yet another embodiment of the present invention is illustrated in FIG. 5. In this embodiment, the transparent front panel 316 is secured by a layer of adhesive 320 to an inturned margin 311*a* of a rear panel 311. The rear panel 311 is preferably fabricated of manila paper which provides a soft fold or hinge line 318 due to the inherent characteristics of the material. This embodiment provides the advantage of eliminating an edge on the inside of the file folder in the same manner as in the embodiment of FIG. 3. It also eliminates the need for providing a soft crease in the front panel for those situations where a flat open condition of the folder is desired.

In view of the foregoing, it should be apparent that the present invention provides a novel file folder which permits documents to be viewed through a transparent front panel and enables the folder to be laid open substantially flat in use. The file folder has structural integrity; i.e. it is relatively rigid and is not "floppy". The file folder is less expensive to manufacture than all-plastic folders, and it is more durable and easier to decorate. The file folder also permits notations to be made thereon with a greater variety of writing implements.

Furthermore, the file folder of the present invention is capable of being opened and closed a number of times without causing the hinge line to fatigue.

While preferred embodiments of the present invention have been described in detail, various modifications, alterations and changes may be made without departing from the spirit and scope of the present invention as defined in the appended claims.

I claim:

1. A file folder consisting essentially of: a rear panel of relatively stiff opaque paper having an inner surface and an outer surface; a front panel of transparent plastic material having imperforate inner and outer surfaces, said front panel adapted to overlie said rear panel and be substantially co-extensive therewith, with said inner surface of said front panel adapted to directly abut said inner surface of said rear panel when said folder is in a closed configuration; a panel margin having imperforate inner and outer surfaces formed as an extension of one of said panels through a flexible fold line; and adhesive means for directly and permanently securing one surface of said panel margin to one surface of the other one of said panels so that the inner surfaces of said panels substantially and proximately overlie each other when said folder is closed and so that said rear panel and said front panel are disposed substantially coplanar when said folder is open.

2. A file folder according to claim 1 wherein said panel margin is an extension of said front panel and wherein said outer surface of said panel margin is permanently secured to the inner surface of said rear panel.

3. A file folder according to claim 1 wherein said panel margin is an extension of said front panel and wherein said inner surface of said panel margin is permanently secured to the outer surface of said rear panel.

4. A file folder according to claim 1 wherein said panel margin is an extension of said rear panel and wherein said outer surface of said panel margin is permanently secured to the inner surface of said front panel.

5. A file folder according to claim 1 wherein said panel margin is an extension of said rear panel and wherein said inner surface of said panel margine is permanently secured to the outer surface of said front panel.

* * * * *